US007370680B2

(12) United States Patent
Fezer

(10) Patent No.: US 7,370,680 B2
(45) Date of Patent: May 13, 2008

(54) LATHE HAVING MOVABLE SPINDLES AND METHOD

(76) Inventor: Carlos Alberto Fernando Fezer, Run Gerhard Fezer, 865, Cacador, S.C. (BR) 89500

( * ) Notice: Subject to any disclaimer, the term of this patent is extended or adjusted under 35 U.S.C. 154(b) by 0 days.

(21) Appl. No.: 11/368,309

(22) Filed: Mar. 3, 2006

(65) Prior Publication Data

US 2007/0204933 A1 Sep. 6, 2007

(51) Int. Cl.
*B27L 5/02* (2006.01)

(52) U.S. Cl. ..... 144/362; 144/332; 144/209.1

(58) Field of Classification Search .. 144/209.1–215.4, 144/332, 362

See application file for complete search history.

(56) References Cited

U.S. PATENT DOCUMENTS 1,243,909 A * 10/1917 Woodsum ..... 144/209.1
4,469,155 A 9/1984 Platt
4,549,587 A 10/1985 Hasegawa et al.
4,559,987 A 12/1985 Fondronnier et al.
4,579,159 A 4/1986 Platt
4,602,663 A 7/1986 Browning, Jr. et al.
4,632,161 A 12/1986 Kajikawa et al.
4,781,229 A 11/1988 Wilson
4,815,508 A 3/1989 Carter et al.
4,901,777 A 2/1990 Koike
5,018,561 A 5/1991 Shimosaka et al.
5,333,658 A 8/1994 Albion et al.
5,564,253 A 10/1996 Nakaya
5,971,045 A 10/1999 Watanabe
5,972,360 A 10/1999 Braun
6,116,306 A 9/2000 Ely
6,357,496 B1 3/2002 Koike
6,648,036 B2 11/2003 Watanabe
6,701,983 B1 3/2004 Koike

* cited by examiner

*Primary Examiner*—Shelley M. Self
(74) *Attorney, Agent, or Firm*—Hodgson Russ LLP

(57) ABSTRACT

A lathe having first and second support walls that support pairs of vertical and elevated vertical guides, and having frames that support horizontal guides. Trunnions are mounted on the vertical guides and support a log peeling assembly. A structure supporting back-up powered rollers is mounted on the elevated vertical guides. First and second spindle assemblies are mounted on the horizontal guides for movement between a first working position where a log to be peeled is gripped and rotated, and a second working position where the log continues its rotation into a knife extending from the log peeling assembly to produce veneer. When a predetermined log diameter is reached the first and second spindle assemblies release and return to the first working position to grip another log, while the log being rotated continues to be peeled until it reaches a minimum core diameter.

12 Claims, 6 Drawing Sheets

LATHE HAVING MOVABLE SPINDLES AND METHOD

FIELD OF INVENTION

This invention relates to lathes and lathing processes to produce veneer from a log.

BACKGROUND

The production of veneers that are used in the manufacture of plywood is becoming more and more dependent on renewable resources, for example, logs used in the production of veneer come from reforested tree species. These reforested tree species are turning in logs of smaller diameter for the production of veneer. Thus, in order to be capable of producing veneer with lower costs and higher yields from log volume to veneer volume, there is a need for faster lathes which turn the wood logs to final smaller cores.

Standard lathes have fixed mechanical spindles located for gripping the ends of a log to be peeled, and the spindles rotate the log against a knife. The knife moves on a horizontal path and is indexed incrementally forward in a direction toward the log at a rate synchronized to the rotation of the log. The veneer is peeled off in a spiral manner from the log as the log is rotated against the knife. The amount of incremental forward movement determines the thickness of the peeled veneer. The spindles can be dual telescopic spindles on each end of the log or three telescopic spindles on each end of the log. These lathes can work with any shape and size of logs. However, the minimum diameter of the core remaining after the peeling of the log is finished is determined by the diameter of the smaller of the spindles in the dual or three telescopic arrangement.

There are also spindleless lathes which keep the center of rotation of the log in a fixed position, independent of the existence of mechanical spindles at the end of the log, and this arrangement allows the peeling process to continue to smaller core sizes. However, the disadvantage with this type of lathe is that it is only good for use with pre-rounded logs. In other words, the absence of mechanical spindles at the ends of the log requires that the outside surface of the log be cylindrical to allow adequate transfer of torque from the driving rollers to the log to thus peel veneer from the cylindrical log.

There are also mixed lathes which have single spindles on each end of the log during the initial portion of the peeling process. The spindles release the log when a certain diameter is reached. The peeling process continues after the release of the spindles by pure spindleless action as described above.

However, although standard lathes and mixed lathes can work with any shape of log and produce veneer down to a small core, they have the significant disadvantage of requiring a down time. During the down time, a new log is moved into position in the lathe so that it can be peeled. For example, when the peeling process reaches the core the lathe must be stopped, and the lathe knife carriage and associated counter rollers must be opened to allow for the introduction of a new log. Then, a separate apparatus brings the new log inside into the lathe machine. The mechanical spindles move in to grip both ends of the log, which is stationary, and then the apparatus is moved away to allow the spindles to start rotating the log against the knife, which will start indexing against the knife to peel the log and thus produce the veneer.

Thus, there is a significant need to eliminate the down time associated with presently existing lathes. There is also a need to increase the efficiency of the log peeling process.

SUMMARY

The present invention advantageously provides for a faster lathe that turns logs into veneer and a final small diameter core, and produces veneer at a high yield from log volume to veneer volume, at lower production costs. The lathe has a first support wall having a first opening and a first pair of vertical guides and an elevated second pair of vertical guides. The first support wall faces a second support wall having a second opening and a third pair of vertical guides and a fourth pair of elevated vertical guides. The first and third pairs of vertical guides are disposed in a face to face relationship, and the second and fourth pairs of vertical guides are disposed in a face to face relationship. There is also a first and a second frame, with the first frame supports a first pair of horizontal guides and the second frame supports a second pair of horizontal guides.

The first pair of vertical guides this mounted on the first support wall support a first trunnion, and the third pair of vertical guides that is mounted on the second support wall support a second trunnion, and the first and second trunnions, respective, a log peeling assembly having a blade assembly and a nosebar assembly. The first and second trunnions can be indexed along the first and third pairs of vertical guides. A structure is supported on the elevated second pair and elevated fourth pair of vertical guides, and back-up powered rollers are supported on the structure. The structure can be indexed along the elevated second and fourth pairs of vertical guides.

First and second spindle assemblies are provided and are supported on first and second pairs of horizontal guides that are mounted on first and second frames. The first and second spindle assemblies are independently movable, but are synchronized to move together. The first spindle assembly has a first spindle and the second spindle assembly has a second spindle, and the first and second spindle assemblies are movable between a first working position where they grip and pre-center a log to be peeled, and a second working position at a center of rotation where the log is rotated and peeled. In particular, in the second working position, the first and second spindles rotate the log against a knife clamped in the blade assembly until the log reaches a predetermined diameter. At that point, the first and second spindles retract and move along the first and second guide to grip another log to be peeled, or in other words, to grip an unpeeled log. The first and second spindles grip the unpeeled log and start rotating the unpeeled log, so that when the time comes for the first and second spindle assemblies to move the unpeeled log inside the peeling position, the unpeeled log is already rotating at the required peeling rotation rate. This advantageously accelerates the unpeeled log to the required rotation rate prior to the unpeeled log being moved into the peeling position. It is pointed out that other lathes are slower, because they normally have to spend time accelerating the unpeeled log to the required rotation rate when the unpeeled log is in the peeling position. At the same time, the log being peeled continues to be rotated against the knife and peeled. The log is rotated by torque provided by the back-up powered rollers and a powered powered rotary nosebar that is supported on a nosebar support structure that is part of the nosebar assembly. The peeled veneer exits the lathe, and when the log being peeled is peeled down to its minimum diameter, only a core of wood remains. The core exits the lathe. The log peeling assembly and the back-up powered rollers index away from each other on the vertical guides to make room for the incoming log to be peeled. Once the incoming log is in the second working position, it continues to be rotated by the first and second spindles until it reaches the predetermined diameter, at which point the first and second spindles release from the log being peeled. From there the first and second spindles grip another log to be peeled and the process repeats.

Thus, the lathe advantageously saves time, because no time is lost having to shut the lathe down to bring another log into the lathe. In addition, the lathe advantageously has first and second spindles that can move along horizontal guides to pre-center and grip a log while the lathe continues to peel the log being rotated.

In another embodiment, the knife works on a horizontal plane and the first and second spindles move vertically upward to grip another log and bring it in down to the center of rotation so that the log can be rotated and peeled.

DESCRIPTION

Figure 1:
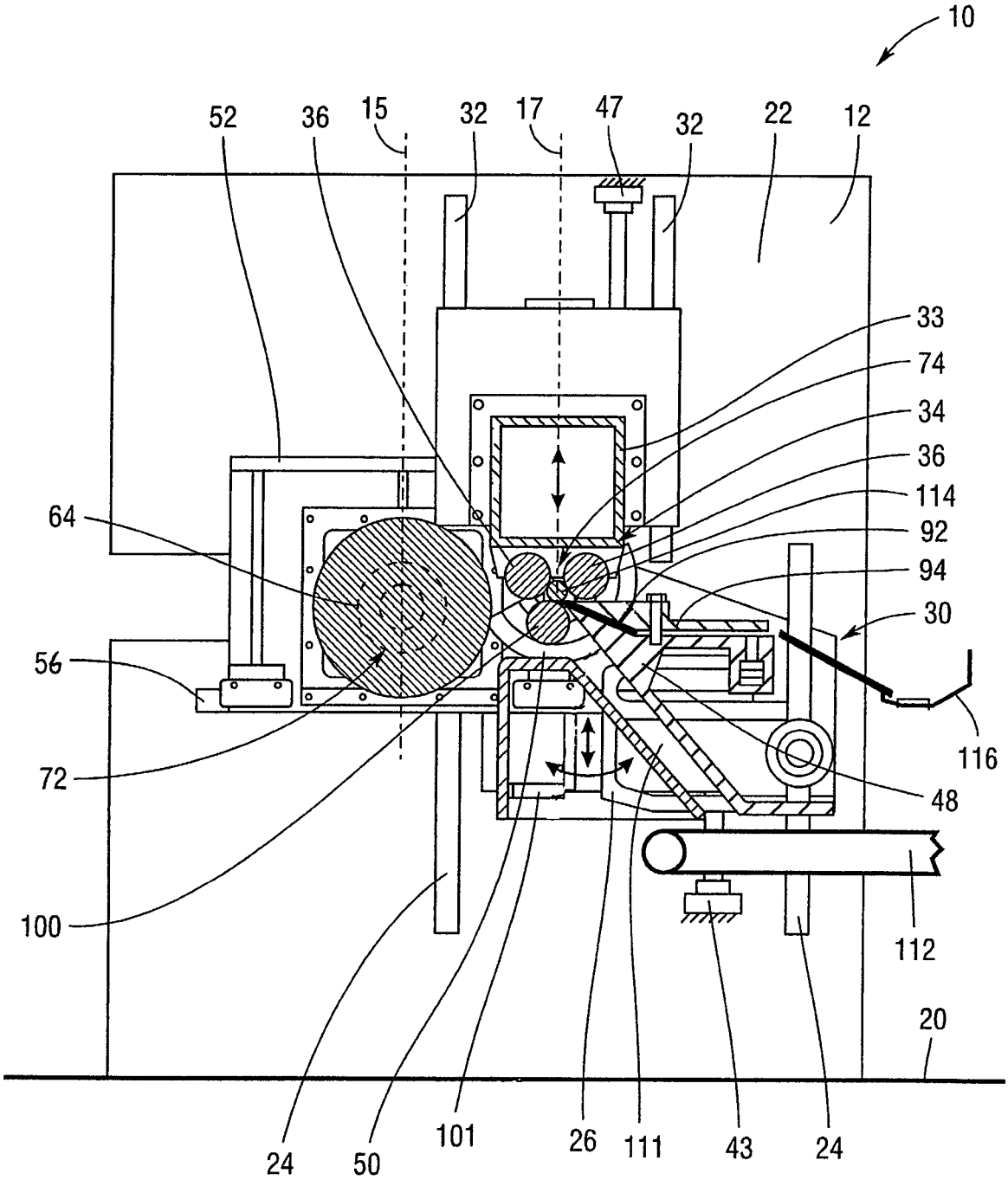
FIG. 1 is a sectional view of the lathe showing a log supported on and being rotated counterclockwise by back-up powered rollers and a powered rotary nosebar, along with an incoming log supported on spindles and being rotated counterclockwise.
Figure 2:
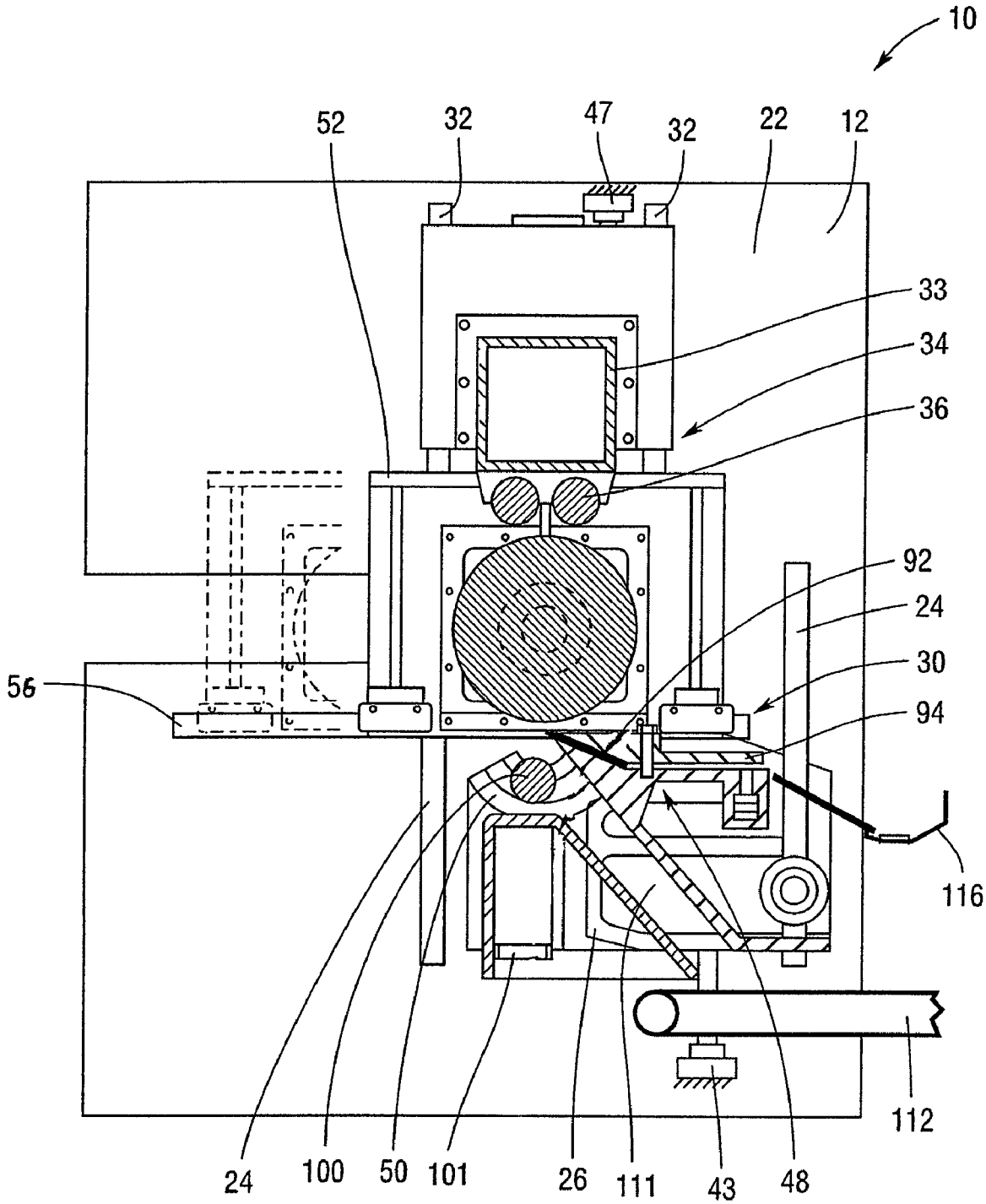
FIG. 2 is a sectional view of the lathe showing a log rotating by the spindles and positioned between the back-up powered rollers and the powered rotary nosebar.
Figure 3:
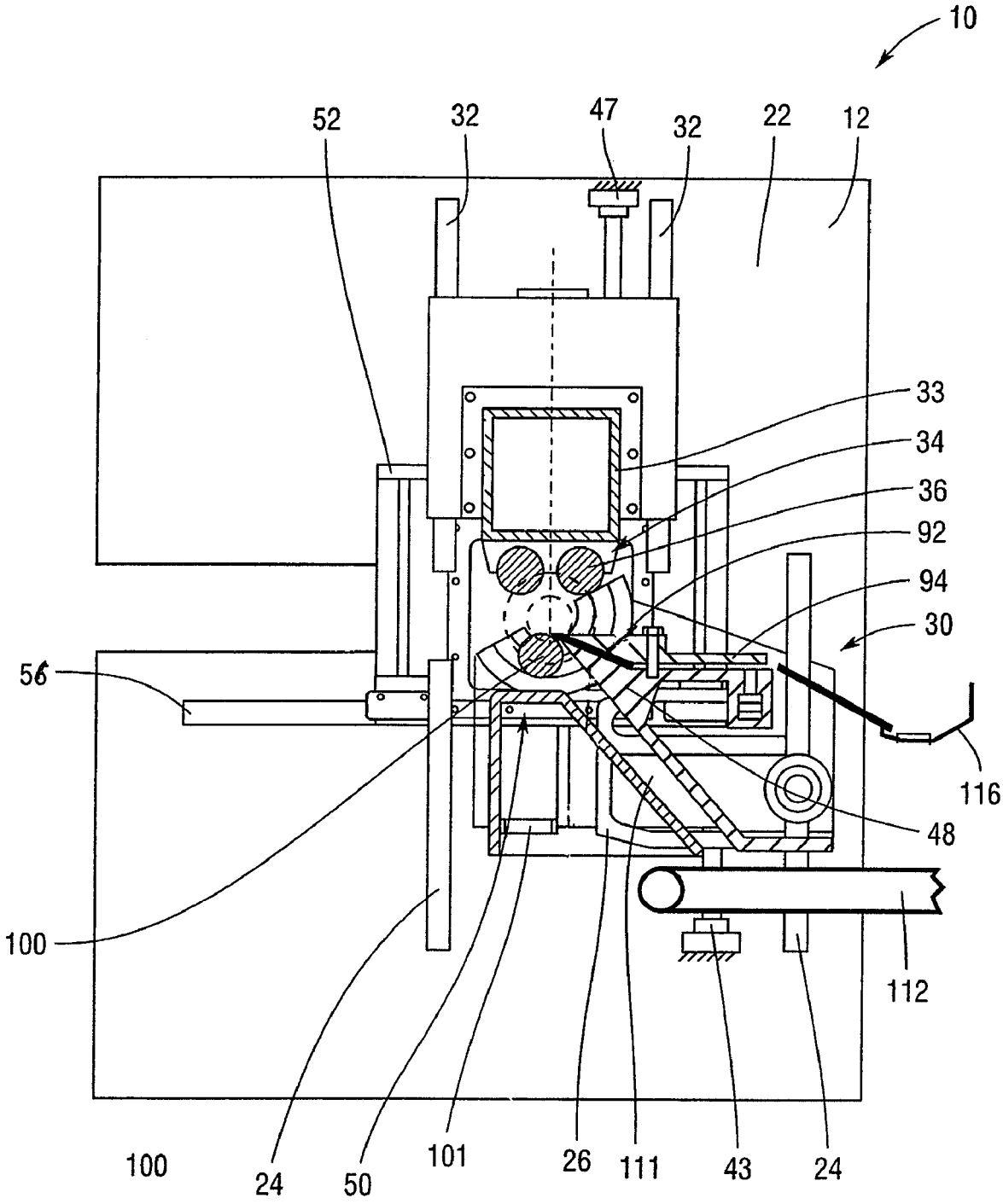
FIG. 3 is a sectional view of the lathe without a log being shown.
Figure 4:
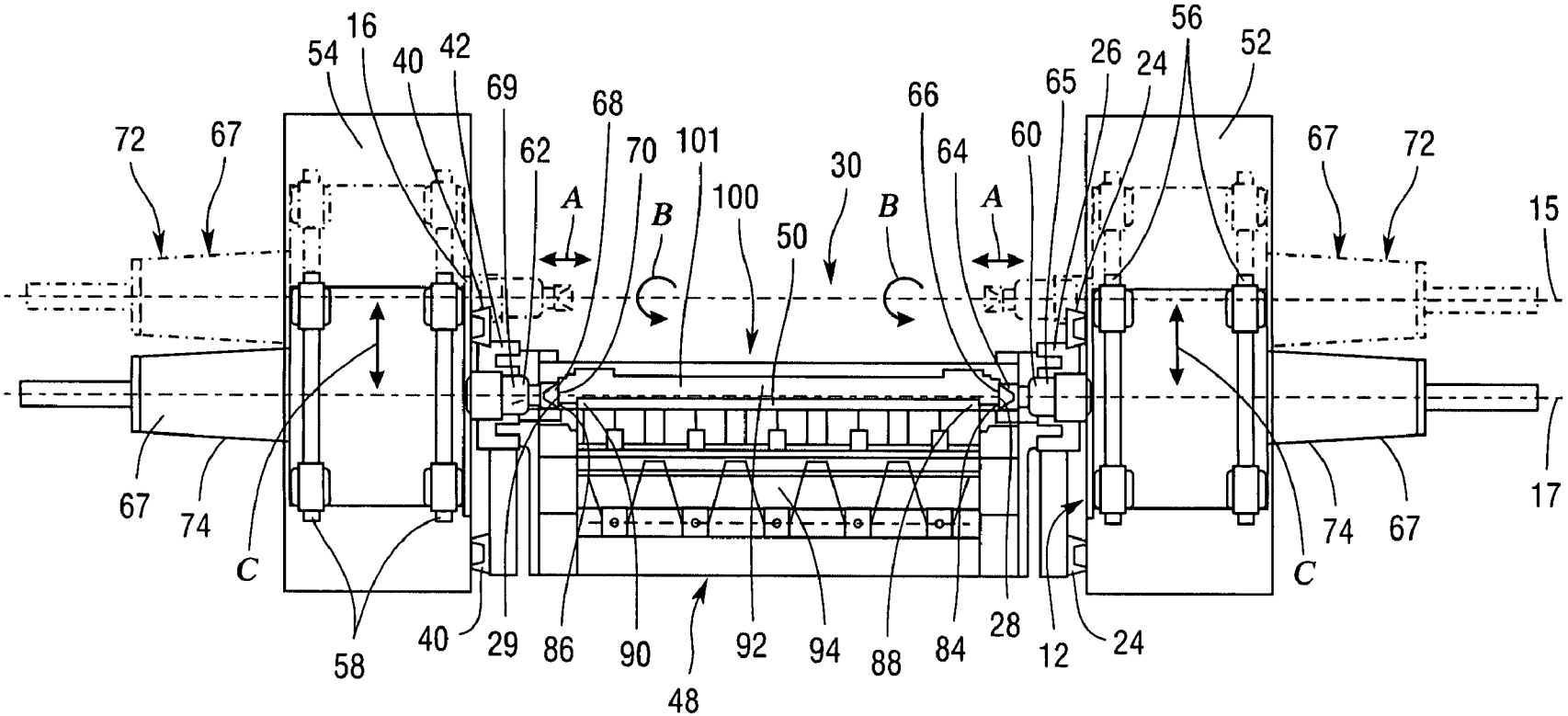
FIG. 4 is a top plan view, partly in section, showing the trunnions, first and second spindle assemblies and the positional range of movement lines of the spindle assemblies wherein the spindles shown in dashed lines are in a first working position and the spindles shown in solid lines are in a second working position, and it is pointed out that the back-up powered rollers are not shown.
Figure 5:
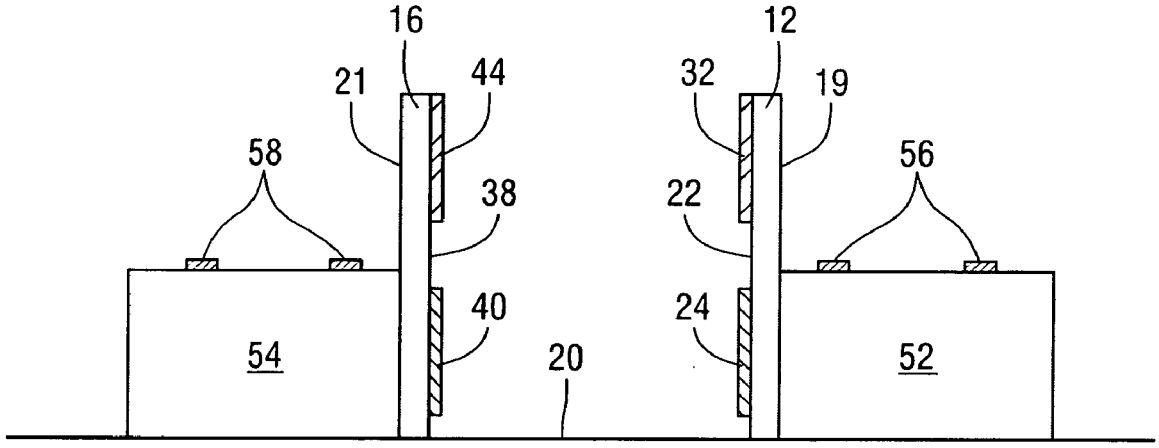
FIG. 5 is a right end diagrammatic view of the lathe without the log peeling assembly, first and second spindle assemblies and back-up rollers being shown.
Figure 6:
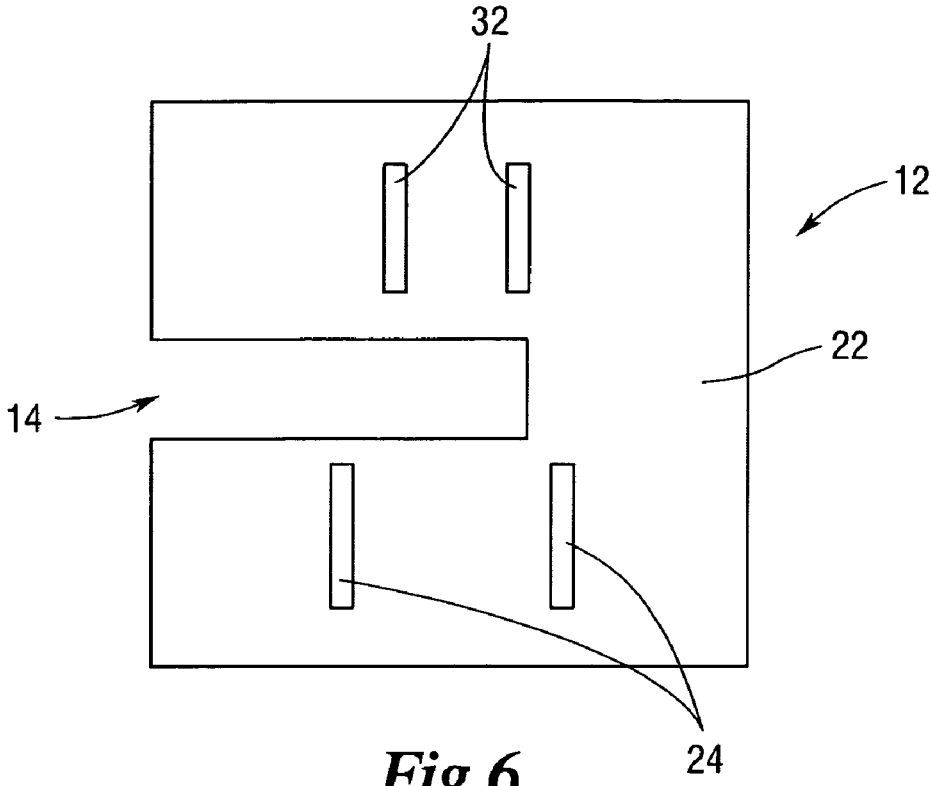
FIG. 6 is a front elevational view of the first support wall.
Figure 7:
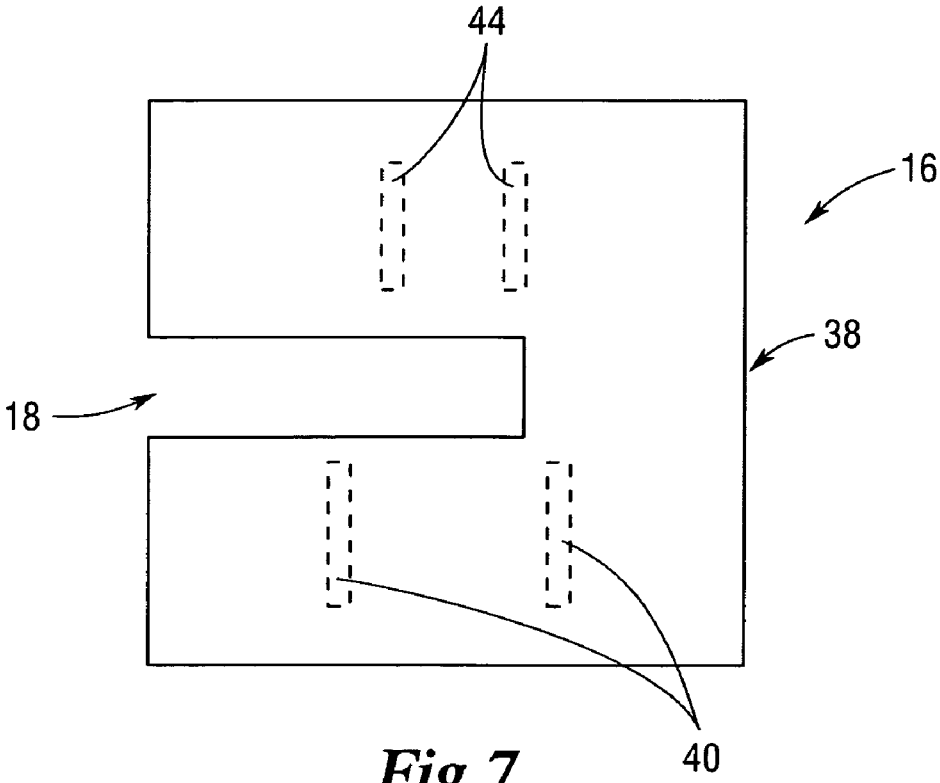
FIG. 7 is a front elevational view of the second support wall.

The lathe 10 is shown generally in FIGS. 1-7, and FIGS. 6-7 show the lathe 10 with a first support wall 12 having a first horizontal opening 14. The first support wall 12 is generally parallel to a second support wall 16 having second horizontal opening 18, as shown in FIG. 7. As shown in FIG. 1, the first support wall 12 is secured and supported on the ground or shop floor 20, as is the second support wall 16, such that the first and second horizontal openings 14, 18, respectively, (FIGS. 6-7) line up with one another. The first support wall 12 supports a first trunnion 26, and the second support wall 16 supports a second trunnion 42, and the first and second trunnions 26, 42, respectively support a log peeling assembly 30 that extends between them, as shown in FIG. 4. The first support wall 12 and the second support wall 16 also support a structure 33 that extends between them and that has back-up powered rollers 36. Also, the first support wall 12 has an outside surface 19 and the second support wall 16 has an outside surface 21, as shown in FIG. 5.

As shown in FIGS. 1-3, the first support wall 12 has an inner surface 22. A first pair of vertical guides 24 is mounted to the inner surface 22. The first pair of vertical guides 24 support the first trunnion 26. As shown in FIG. 4, the first trunnion 26 supports a first end 28 of the log peeling assembly 30. There is also a second pair of vertical guides 32 mounted to the inner surface 22 of the first support wall 12. The second pair of vertical guides 32 is elevated with respect to the first pair of vertical guides 24, as shown in FIGS. 1 and 5. The second pair of vertical guides 32 supports structure 33 at a first end 34 thereof.

As shown in FIGS. 5 and 7, the second support wall 16 has an inner surface 38. A third pair of vertical guides 40 is mounted to the inner surface 38 and supports a second trunnion 42. The second trunnion 42 supports a second end 41 of the log peeling assembly 30, in a manner to be described presently. There is also a fourth pair vertical guides 44 mounted to the inner surface 38 of the second support wall 16. The fourth pair of vertical guides 44 is elevated with respect to the third pair of vertical guides 40, as shown in FIG. 5. The fourth pair of vertical guides 44 supports the structure 33 from a second end 46 thereof, and the structure 33 supports the back-up powered rollers 36.

Thus, as shown in FIG. 5 the first pair of vertical guides 24 faces the third pair of vertical guides 40, and the second pair of vertical guides 32 faces the fourth pair of vertical guides 44. The first, second, third and fourth pairs of vertical guides 24, 32, 40, 44, respectively, are joined to the first and second support walls 12, 16, respectively, with bolts or other suitable fasteners.

The first and second trunnions 26, 42, respectively, support the first end 28 and a second end 29 of the log peeling assembly 30, as shown in FIG. 4. The log peeling assembly 30 includes a knife assembly 48 and a nosebar assembly 50. The first and second trunnions 26, 42, respectively, are moved along the above-described first and third pairs of vertical guides 24, 40, respectively, by hydraulic cylinders 43 mounted to the first support wall 12 and the second support wall 16. The hydraulic cylinders 43 rapidly move the first and second trunnions 26, 42, respectively, toward and away from the shop floor 20. Hydraulic cylinders 43 and the control of hydraulic cylinders 43 are well known to those having ordinary skill in the art.

FIG. 5, which is a right end diagrammatic view of the lathe 10, also shows a first frame 52 that abuts against and is, in one of the embodiments, joined to the first support wall 12, and a second frame 54 that abuts against and is joined to the second support wall 16. The first frame 52 supports a first pair of horizontal guides 56, and the second frame 54 supports a second pair of horizontal guides 58. The first pair of horizontal guides 56 is for supporting a first spindle assembly 60, as shown in FIGS. 1-4, and the second pair of horizontal guides 58 is for supporting a second spindle assembly 62 as shown in FIG. 4. The movement of the first spindle assembly 60 along the first pair of horizontal guides 56 is independent from the movement of the second spindle assembly 62 along the second pair of horizontal guides 58. The first and second spindle assemblies 60, 62, respectfully, travel along the first and second pairs of horizontal guides 56, 58, respectfully, independent of one another, but they travel in perfect synchronization by way of servo controlled cylinders as indicated by arrows C in FIG. 4. These servo controlled cylinders are located under the first and second frames 52, 54, respectively, and are therefore not shown in the drawing figures. Servo controlled cylinders are well known to those having ordinary skill in the art.

As shown in FIG. 4, The first spindle assembly 60 has a spindle 64 that can be extended and retracted by a first hydraulic cylinder 65, and the first spindle 64 has a clamping face 66. The second spindle assembly 62 has a spindle 68 that can be extended and retracted by a second hydraulic cylinder 69, and the second spindle 68 has a clamping face 70. This motion is indicated by the horizontal arrows designated A in FIG. 4. The clamping faces 66, 70, respectively, in one of the embodiments, are provided with a contour such that they can readily grip a log 76. The first and second spindle assemblies 60, 62, respectively, are provided with electric servo motors 67 for imparting rotation to the griped log 76, so that the log 76 can be turned at variable speeds, as shown by arrows B in FIG. 4. Electric servo motors are well known to those having ordinary skill in the art. The first and second hydraulic cylinders 65, 69, respectively, thus allow the first and second spindles 64, 68, respectively, to grip and release the log 76.

The first spindle assembly 60 is movable along the first pair of horizontal guides 56, and the second spindle assembly 62 is movable along the second pair of horizontal guides 58 between a first working position 72 (shown in dashed lines in FIG. 4) and a second working position 74 (shown in solid lines in FIG. 4). It is pointed out that the first opening 14 in the first support wall 12 and the second opening 18 in the second support wall 18 advantageously allow for such horizontal movement of the first and second spindle assemblies 60, 62, respectively.

The first working position 72 is that position where the centers of the first and second spindles 64, 68, respectively, coincide with a vertical plane, represented by line 15, passing through the position where the next log 76, which is about to be gripped and brought into the lathe 10, is located. In the first working position 72 the log 76 is gripped from a precentered position, and the first and second spindles 64, 68 start rotating the log 76. The second working position 74 is at a center of rotation where the log 76 is peeled. The center of peeling rotation of the log 76 coincides with the plane passing through line 17, as shown in FIG. 1. When in the second working position 74, the first and second spindles 64, 68, respectively, rotate the log 76 against a knife 92 and the log 76 is peeled. When the log 76 is peeled to a predetermined diameter, the first and second spindles 64, 68, respectively, retract from the log 76 being peeled, and move along the first pair of horizontal guides 56 and the second pair of horizontal guides 58, and return to the first work position 72 to engage another log 76, or in other words, grip and start rotating an unpeeled log. At the same time, the log 76 being peeled continues to be rotated and peeled by the back-up powered rollers 36 and a powered rotary nosebar 100 in a spindleless manner. The powered rotary nosebar 100 is supported on nosebar support structure 101. In one of the preferred embodiments, the predetermined diameter of the log 76 is about 120 millimeters (hereinafter mm). The position of the first and second trunnions 26, 42, respectively, is indicative of when the predetermined log diameter is reached. In particular, the first and second trunnions 26, 42, respectively, carry the blade assembly 48 and they move in to deliver the veneer as the log 76 is rotated. The point at which the first and second spindles 64, 68, respectively, move out can be predetermined by a servo controlled system (not shown). The servo controlled system moves the first and second trunnions 26, 42, respectively, vertically on the first and third pairs of vertical guides 24, 40, respectively, such that the positions of the first and second trunnions 26, 42, respectively, are known at all times. This is possible, because the position of the cylinders 43 moving the first and second trunnions 26, 42, respectively is monitored at all times. A command is sent to first and second spindles 64, 68, respectively, such that they move out when the log is at 120 mm. By changing the command, the diameter of the log 76 at which the first and second spindles 64, 68, respectively, move out could be varied to be, for example, be 119 mm, 118 mm or other predetermined amount. Monitoring the position of cylinders and the control of such cylinders is well known to those having ordinary skill in the art.

Thus, the new lathe 10 advantageously eliminates the down time, because no time is lost having to stop the lathe 10 to bring a new log 76 into the lathe for peeling.

As shown in FIG. 4, the log peeling assembly 30 includes the nosebar assembly 50 and the blade assembly 48, and the nosebar assembly 48 has a first end 84 supported on the first trunnion 26 and a second end 86 supported on the second trunnion 42. The knife assembly 48 has a first end 88 supported on the first trunnion 26 and has a second end 90 supported on the second trunnion 42. The knife assembly 48 includes the knife 92 for peeling the log 76 as the log 76 is turned or rotated. The knife 92 is held between clamping plates 94. The nosebar assembly 50 includes two position controlled hydraulic cylinders that act on the nosebar support structure 101, and an electric servomotor (not shown) powers the powered rotary nosebar 100, as shown in FIG. 1. The two position controlled hydraulic cylinders (not shown) move the nosebar support structure 101 so that the nosebar support structure 101 has vertical movement within the first and second trunnions 26, 42, respectively. Position controlled hydraulic cylinders well known to those having ordinary skill in the art. This allows movement for a large opening to be made between the knife 92 and the powered rotary nosebar 100 for removing thick material from the log 76 during rounding-up of the log 76, and also advantageously adjusts the gap between the knife 92 and the powered rotary nosebar 100 as the log 76 decreases in diameter as it is peeled.

As shown in FIG. 2, in order for the log 76 to fit between the log peeling assembly 30 and the back-up powered rollers 36, the first and second trunnions 30, 42, respectively, move on the first and third pairs of vertical guides 24, 40, respectively, and the back-up powered rollers 36 move on the second and fourth pairs of vertical guides 32, 44, respectively, in a direction away from one another. It is pointed out that because the knife assembly 48 and the nosebar assembly 50 are supported by the first and second trunnions 26, 42, respectively, the knife assembly 48 and nosebar assembly 50 can be advantageously rotated to set a cutting pitch and provide the correction required to keep a constant release angle as the diameter of the log 76 decreases as the log 76 is peeled. In addition, because the first trunnion 26 runs on the first pair of vertical guides 24 and the and second trunnion 42 runs on the third pair of vertical guides 40, the log peeling assembly 30 can be rapidly positioned and indexed.

FIG. 1 also shows the back-up powered rollers 36, with the log 76 positioned between the back-up powered rollers 36 and the powered rotary nosebar 100. As previously described, structure 33 which supports the back-up powered rollers 36 is mounted on the second and fourth pairs of vertical guides 32, 44, respectively, and thus it can be moved vertically toward or away from the log peeling assembly 30 by way of hydraulic cylinders 47 mounted on the first support wall 12 and the second support wall 16 acting on the structure 33. Hydraulic cylinders 47 and the control thereof are well known to those having ordinary skill in the art. Thus, the back-up powered rollers 36 can be moved in the direction of the log peeling assembly 30 to hold the log 76 in position and to provide torque, which, along with torque supplied by the powered rotary nosebar 100 drives the log 76 into the knife 92, such that veneer (not shown) is produced.

As shown in FIG. 1, there is a gap 111 between the knife assembly 48 and the nosebar assembly 50, and the veneer exits the lathe 10 through the gap 111 and moves onto a conveyor 112. When the log 76 diameter has been peeled to the predetermined diameter, a log core 114 shown in FIG. 1 rolls out over the knife clamping plates 94 to a side transfer core conveyor 116 that travels with the first and second trunnions 26, 42, respectively. The core 114 can be used to manufacture other wood products.

In use, FIG. 1 shows the end of the peeling process where the log 76 has been reduced to a core 114 that has such a small diameter that it can no longer be peeled. The first and second spindles 64, 68, respectively, are in the forward or first working position 72 coinciding with the plane passing through line 15. The log 76, which is not yet peeled, is gripped at its ends by the first and second spindles 64, 68, respectively.

The first and second trunnions 26, 42, respectively, move in a direction toward the shop floor 20, and structure 33 that carries the back-up powered rollers 36 moves in the opposite direction away from the shop floor 20, thus creating a gap for the log 76 to be moved into the lathe 10. Then hydraulic cylinders 98 that support the powered rotary nosebar 100 retracts, creating a large gap 111 between the knife 92 and the powered rotary nosebar 100. The first and second spindles 64, 68, respectively, start rotating the new log 76 as they start moving along the first and second pairs of horizontal guide 56, 58, respectively, to the center of rotation at the second work position 74 where log 76 is rotated and peeled. The first and second trunnions 26, 42, respectively, and structure 33 move as much as it is necessary to create the opening for the log 76, such that the log 76 can be positioned between the powered rotary nosebar 100 and back-up powered rollers 36.

FIG. 2 shows the first spindle 64 in the second working position 74 that coincides with the center of rotation. In the second working position 74 the first and second spindles 64, 68, respectively, rotate the log 76 into the knife 92 which produces veneer that is released into the gap 111 between the knife assembly 48 and nosebar assembly 50. From there the veneer moves onto the conveyor 112. The first and second trunnions 26, 42, respectively, and the back-up powered rollers 36, index in a direction toward the log 76 being peeled by increments equal to the veneer thickness that is produced. As previously mentioned, when the diameter of the log 76 equals the predetermined log diameter, the first spindle 64 and the second spindle 68 release, and the peeling of the log 76 continues in a spindleless manner. The torque required to continue the rotation of the log 76 against the knife 92 is provided by the powered rotary nosebar 100 and the back-up powered rollers 36 all of which rotate against the cylindrical surface of the log 76 being peeled. At the same time, the first spindle 64 and the second spindle 68 to return to the first working position 72 and shown as line 15 to grip another log 76. After the log 76 is peeled down to the core 114 and the core 114 is expelled out of the lathe 10, the log peeling assembly 30 and back-up powered rollers 36 immediately index away from one another to make room for the incoming log 76 supported on the first and second spindles 64, 68, respectively. The above-describe peeling process repeats.

Thus, the lathe 10 and associated method advantageously decreases the time to produce veneer, because veneer is produced initially using the first spindle 64 and the second spindle 68 to spin the log 78. The first and second spindles 64, 68, respectively, release when the log 76 reaches a predetermined diameter, at which time the rotation of the log 76 is accomplished by the powered rotary nosebar 100 and back-up powered rollers 36. As a result, the first and second spindle assemblies 62, 64, respectively, advantageously are free to move to the first working position 72 and grip and start rotating another log 76 while the lathe 10 continues peeling the log 76 which continues rotating by the power of the powered rotary nosebar 100 and the back-up powered rollers 36.

It will be appreciated by those skilled in the art that while a lathe having movable spindles and method have been described above in connection with particular embodiments and examples, the invention is not necessarily so limited, and other embodiments, examples, uses, and modifications and departures from the described embodiments, examples, and uses may be made without departing from this invention. All of these embodiments are intended to be within the scope and spirit of the present lathe having movable spindles and method.

What is claimed is:

1. A lathe for peeling a log, the lathe comprising:

a first support wall having a first pair of vertical guides and a second pair of vertical guides and a second support wall having a third pair of vertical guides and a fourth pair of vertical guides, such that the first and third pairs of vertical guides are in a face to face relationship and the second and fourth pairs of vertical guides are in a face to face relationship and the second and fourth pairs of vertical guides are elevated with respect to the first and third pairs of vertical guides, a first trunnion mounted on the first pair of vertical guides and a second trunnion mounted on the third pair of vertical guides and a log peeling assembly with a knife supported by the first trunnion and the second trunnion for movement on the first and third pairs of vertical guides, a structure having back-up powered rollers mounted on the second and fourth pairs of vertical guides for movement thereon, a first frame joined to the first support wall having a first pair of horizontal guides with a first spindle assembly supported on the first pair of horizontal guides and a second frame joined to the second support wall having a second pair of horizontal guides with a second spindle assembly supported on the second pair of horizontal guides, and the first spindle assembly capable of being moved along the first pair of horizontal guides and the second spindle assembly capable of being moved along the second pair of horizontal guides from a first working position to a second working position and wherein in the first working position the first spindle assembly and the second spindle assembly are caused to engage and impart rotation to the log to be peeled and wherein in the second working position the first spindle assembly and the second spindle assembly are for rotating the log, and further wherein in the second working position the log peeling assembly and the back-up powered rollers are for contacting and supporting the log to impart rotation to the log such that the log is peeled when in contact with the knife and further wherein the first and second spindle assemblies are capable of releasing from the log to return to the first working position to engage another log to be peeled while at the same time the log peeling assembly and back-up powered rollers continue to rotate the log against the knife in order to peel the log.

2. The lathe according to claim 1 wherein the log peeling assembly further includes a nosebar assembly having a powered rotary nosebar and at least one position controlled hydraulic cylinder for moving the powered rotary nosebar in the vertical direction and the powered rotary nosebar for contacting and rotating the log.

3. The lathe according to claim 1 wherein the first support wall has a first opening and the second support wall has a second opening and the first and second openings line up with one another and are for allowing horizontal movement of the first spindle assembly and the second spindle assembly.

4. The lathe according to claim 3 wherein the first and second pairs of vertical guides are mounted to an inside surface of the first wall and the third and fourth pairs of vertical guides are mounted to an inside surface of the second support wall.

5. The lathe according to claim 4 wherein the first frame abuts against an outside surface of the first support wall and the second frame abuts against an outside surface of the second support wall and the first spindle assembly extends though the first opening and the second spindle assembly extends though the second opening such that the first spindle assembly can be horizontally moved back and forth on the first pair of horizontal guides and the second spindle assembly can be moved horizontally back and forth along the second pair of horizontal guides between the first working position and the second working position.

6. The lathe according to claim 5 wherein the first spindle assembly and the second spindle assembly are capable of releasing from the log in the second working position when a diameter of the log equals a predetermined diameter.

7. A method of peeling a log comprising:

providing a lathe having a first support wall having a first pair of vertical guides and a second pair of vertical guides and providing a second support wall having a third pair of vertical guides and a fourth pair of vertical guides, such that the first and third pairs of vertical guides are disposed in a face to face relationship and the second and fourth pairs of vertical guides are disposed in a face to face relationship, and such that the second pair of vertical guides is disposed above the first pair of vertical guides and the fourth pair of vertical guides is disposed above the third pair of vertical guides, providing a first trunnion and mounting the first trunnion on the first pair of vertical guides and providing a second trunnion and mounting the second trunnion on the third pair of vertical guides and providing a log peeling assembly and supporting the log peeling assembly on the first trunnion and the third trunnion for movement on the first and third pairs of vertical guides, providing a structure having back-up powered rollers and mounting the structure on the second and fourth vertical guides for movement thereon and such that the structure is disposed above the log peeling assembly, providing a first frame having a first pair of horizontal guides and supporting a first spindle assembly on the first pair of horizontal guides and joining the first frame to the first support wall and providing a second frame having a second pair of horizontal guides supporting a second spindle assembly on the second pair of horizontal guides and joining the second frame to the second support wall, and moving the first and the second spindle assemblies along the first and the second pairs of horizontal guides between a first working position where the first spindle assembly and the second spindle assembly engage a log to be peeled and impart rotation to the log and a second working position where the first spindle assembly, the second spindle assembly, the log peeling assembly, and the back-up powered rollers contact and impart rotation to the log to rotate the log against a blade clamped in the log peeling assembly, and causing the first and second spindle assemblies to release from the log and return to the first work position to grip another log while the log peeling assembly and back-up powered rollers continue to support and rotate the log into the blade and peel the log.

8. The method according to claim 7 further wherein the first spindle assembly and the second spindle assembly release the log when a diameter of the log equals a predetermined diameter.

9. A lathe for peeling a log, the lathe comprising:

a first support wall and an opposed second support wall and a log peeling assembly mounted on the first support wall and the second support wall and the log peeling assembly having a blade assembly with a knife, a first spindle assembly supported on a first pair of horizontal guides that are mounted on a first frame and the first frame is joined to the first support wall, and the first spindle assembly is for imparting rotation to the log and is capable of being moved between a first working position and a second working position, a second spindle assembly supported on a second pair of horizontal guides mounted on a second frame and the second frame is joined to the second support wall, and the second spindle assembly is for imparting rotation to the log and is capable of being moved between the first working position and the second working position and wherein the first pair of horizontal guides mounted on the first frame and the second pair of horizontal guides mounted on the second frame are mounted in a side by side relationship along an X axis, and wherein the first spindle assembly and the second spindle assembly are capable of gripping, pre-centering and imparting rotation to the log when the first spindle assembly and the second spindle assembly are positioned in the first working position, and when the first spindle assembly and the second spindle assembly are positioned in the second working position the first spindle assembly and the second spindle assembly are positioned at a center of rotation such that the log is rotated by the first spindle assembly and the second spindle assembly against the knife in order to peel the log.

10. The lathe according to claim 9 further comprising a first pair and a second pair of vertical guides mounted on the first support wall and a third pair and a fourth pair of vertical guides mounted on the second support wall, such that the first pair of vertical guides is disposed opposite the third pair of vertical guides and the second pair of vertical guides is disposed opposite the fourth pair of vertical guides and wherein the first and third pairs of vertical guides are disposed below the second and fourth pair of vertical guides and support first and second trunnions on which the log peeling assembly is mounted and the second and fourth pairs of vertical guides support a structure having back-up powered rollers for rotating the log.

11. The lathe according to claim 10 wherein when in the second working position the first spindle assembly and the second spindle assembly are for supporting and rotating the log against the knife until the log reaches a predetermined diameter as determined by a position of the first and second trunnions at which time the first spindle assembly and the second spindle assembly are retracted and horizontally moved to the first working position to grip, pre-center and begin rotation of an unpeeled log while the log being peeled continues to be and peeled in a spindleless manner by the back-up powered rollers and the log peeling assembly that contact and impart rotation to the log.

12. The lathe according to claim 11 wherein the log peeling assembly further includes a powered rotary nosebar for contacting and rotating the log.

* * * * *